United States Patent [19]

Igarashi et al.

[11] Patent Number: 4,646,113

[45] Date of Patent: Feb. 24, 1987

[54] HEAT-SENSITIVE RECORDING SHEET

[75] Inventors: Akira Igarashi; Kensuke Ikeda; Kenji Ikeda, all of Shizuoka, Japan

[73] Assignee: Fuji Photo Film Co., Ltd., Kanagawa, Japan

[21] Appl. No.: 863,479

[22] Filed: May 15, 1986

[30] Foreign Application Priority Data

May 16, 1985 [JP] Japan ..... 60-104684

[51] Int. Cl.[4] ..... B41M 5/18

[52] U.S. Cl. ..... 346/209; 346/208; 346/216; 346/217; 346/225; 427/150

[58] Field of Search ..... 346/208, 209, 216, 217, 346/225; 427/150, 151, 152

[56] References Cited

U.S. PATENT DOCUMENTS 4,531,140 7/1985 Suzuki et al. ..... 346/209

*Primary Examiner*—Bruce H. Hess

*Attorney, Agent, or Firm*—Sughrue, Mion, Zinn, Macpeak, and Seas

[57] ABSTRACT

A heat-sensitive recording sheet comprises a colorless or pale-colored electron donating colorless dye precursor, an electron accepting compound which forms color when reacted upon heating with the colorless dye precursor and a heat-fusible substance. The electron accepting compound is 1,4-bis(p-hydroxycumyl) benzene and the heat-fusible substance is 1-p-ethylphenoxy-2-phenoxyethane.

5 Claims, No Drawings

HEAT-SENSITIVE RECORDING SHEET

FIELD OF THE INVENTION

The present invention relates to a heat-sensitive recording sheet, and more particularly it relates to a heat-sensitive recording sheet having an excellent heat-response property at low temperatures and an excellent fog resistance to solvents such as those contained in a fluorescent pen or felt pen.

BACKGROUND OF THE INVENTION

A heat-sensitive recording sheet as used herein refers to a sheet on which images can be recorded by causing physical and chemical changes of substances within the sheet by heat energy, and many processes thereof have been investigated.

A wax type heat-sensitive recording paper which relies on the physical change of a substance caused by heat energy has been described in the prior art, and is used to make electrocardiograms. Heat-sensitive recording sheets which rely on the chemical change of a substance caused by heat energy have been proposed based on various color-forming mechanisms as the chemical change. Among these, a heat-sensitive recording sheet which forms color due to reaction of two compounds is the most typical example.

A heat-sensitive recording sheet forming color due to the reaction of two compounds can be prepared by dispersing two heat-reactive compounds finely, adding a binder so that two compounds are separated from each other, and then coating these compositions on a support. The record can be obtained in this heat-sensitive sheet by heating the sheet to melt one or both of these compounds, to bring about contact of the two heat reactive compounds with each other, and thereby to initiate the color forming reaction.

The two heat-reactive compounds are generally an electron donating compound and an electron accepting compound.

The heat-sensitive recording sheet forming color due to reaction of the two reactive compounds has a number of advantages, such as, (1) color forming is primary color forming and so development is unnecessary, (2) the paper quality is nearly that of normal paper and (3) the recording sheet is easy to handle. Particularly when a colorless dye is used as an electron donating compound, the heat-sensitive recording sheet has the further advantages that (4) color density is high and (5) heat-sensitive recording papers having various color forming hue can easily be prepared. Accordingly, the above heat-sensitive recording sheet is the most widely used.

Recently, heat-sensitive recording sheets have been used in the fields of faxcimile sending, a recording apparatus, and a printing. With the increased use in the faxcimile field, recording speed has been shortened. Improvement for shortening the heat pulse toward a sheet, that is, a color forming property obtained with low heat energy, i.e., a good heat response property, has strongly been desired.

Particularly when the environmental temperature is low, more specifically, when the temperature is 10° C. or less, a sufficient printed density can not be obtained in a general heat-sensitive recording sheet.

On the other hand, since the color forming of the heat-sensitive recording sheet is primary color forming, a problem arises because the electron donating colorless dye precursor and the electron accepting compound are reacted not only by heat but also by solvents and the like, such as those contained in a felt pen or a fluorescent pen which is commonly used for writing on the sheet. Because most of the materials for making the heat-sensitive recording sheet are organic compounds, which have high solubility to the solvents, the heat reactive compounds are easily brought into contact with solvents, and therefore they easily react with a solvent. In order to remove the above defect, efforts have been made to provide a protective layer having solvent resistance on the heat sensitive color forming layer. However, the manufacturing process thereof is complicated.

SUMMARY OF THE INVENTION

An object of the present invention is to provide a heat-sensitive recording sheet which has an excellent heat-response property and is difficult to color-form with solvents and the like.

To achieve the foregoing objects and in accordance with its purpose, the present invention provides a heat-sensitive recording sheet comprising a colorless or pale-colored electron donating colorless dye precursor, an electron accepting compound which forms color when reacted upon heating with the colorless dye precursor and a heat-fusible substance, wherein the electron accepting compound is 1,4-bis(p-hydroxycumyl)benzene and the heat-fusible substance is 1-p-ethylphenoxy-2-phenoxyethane.

DETAILED DESCRIPTION OF THE INVENTION

The object of the present invention can be attained by using 1,4-bis(p-hydroxycumyl)benzene as an electron accepting compound and 1-p-ethylphenoxy-2-phenoxyethane as a heat-fusible substance in a heat-sensitive recording sheet.

1,4-bis(p-hydroxycumyl)benzene used in the present invention can be obtained by Friedel Crafts reaction of diisopropenylbenzene with 2 mole equivalents of phenol in the presence of an acid catalyst such as Al-$Br_3$, $AlCl_3$ and $FeCl_3$. The crystal thereof is a white acicular crystal and has a melting point of 145° C.

The 1,4-bis(p-hydroxycumyl)benzene electron accepting compound employed in the present invention has a lower solubility in solvents used for writing on stationeries, such as ethanol, toluene, cellosolve, (e.g., methylcellosolve), glycol, pyrrolidone, ethanol amine and the like, than those electron accepting compounds conventionally used for heat-sensitive recording papers, such as 2,2-bis(p-hydroxyphenyl)propane [bisphenol A], p-hydroxybenzoic acid, benzyl-4-hydroxy benzoate, 1,1-bis(p-hydroxyphenyl)cyclohexane and the like. Moreover, the occurrence of fog caused by these solvents can be reduced significantly when the electron accepting compound employed in the present invention is used for a heat-sensitive recording paper. These excellent features are significantly shown in 1,4-bis(p-hydroxycumyl)benzene but are scarcely shown in other similar compounds such as 1,3-bis(p-hydroxycumyl)-benzene.

However, since 1,4-bis(p-hydroxycumyl)benzene has a high melting point, i.e., 145° C., a sufficient heat response property at a low temperature can not be expected. The inventors of the present invention have made extensive investigation on this point and found that 1-p-ethylphenoxy-2-phenoxyethane is excellent as a heat-fusible substance.

1-p-ethylphenoxy-2-phenoxyethane can be prepared, for example, by reacting p-phenoxyethyltosylate with p-ethylphenol in the presence of potassium carbonate in dimethylformamide. The melting point of 1-p-ethylphenoxy-2-phenoxyethane thus obtained is 106° C. In accordance with the present invention, it has been found that the heat-response property at a low temperature of 1,4-bis(p-hydroxycumyl)benzene can be improved by a combined use of 1-p-ethylphenoxy-2-phenoxyethane and 1,4-bis(p-hydroxycumyl)benzene without causing deterioration of the resistance to solvents of 1,4-bis(p-hydroxycumyl)benzene. In contrast, the use of compounds similar to 1-p-ethylphenoxy-2-phenoxyethane, such as 1,2-bis(ethylphenoxy)ethane, 1,2-diphenoxyethane, 1-p-ethylphenoxy-2-phenoxybutane stearic acid amide, benzyl p-benzyloxy benzoate or 1-p-butylphenoxy-2-phenoxyethane do not bring about sufficient improvement.

The colorless or pale-colored electron donating colorless dye precursors which can be used in the present invention include triaryl methane compounds, diphenyl methane compounds, xanthene compounds, thiazine compounds and spiropyran compounds. Among these triaryl methane compounds and xanthene compounds are preferably used. Examples thereof include 3,3-bis(p-dimethylaminophenyl)-6-dimethylaminophthalide (i.e., crystal violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis-(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrol-2-yl)-6-dimethylaminophthalide, 3-diethylamino-7-methoxyfluoran, 3-diethylamino-6-methoxyfluoran, 3-diethylamino-7-dibenzylaminofluoran, 3-diethylamino-6-methyl-7-anilinofluoran, 3-N-ethyl-N-tolylamino-6-methyl-7-anilinofluoran, 3-N-methyl-N-tolylamino-6-methyl-7-anilinofluoran, 3-piperidino-6-methyl-7-anilinofluoran, 3-diethylamino-6-chloro-7-anilinofluoran, 3-N-cyclohexyl-N-methylamino-6-methyl-7-anilinofluoran, 3-piperidino-6-methyl-7-(p-methylanilino)fluoran, 3-diethylamino-7-(o-chloroanilino)-fluoran, 3-diethylamino-7-butylaminofluoran, 3-diethylamino-7-diphenetylaminofluoran, 3,7-bis(methyltolylamino)fluoran, 3-piperidino-7-phenetylaminofluoran, 2-anilino-3-chloro-6-diethylaminofluoran 3-diethylamino-7-phenylfluoran, 3-diethylamino-7,8-benzofluoran and the like.

In some cases, these compounds can be mixed in order to adjust color tone or to improve the weather resistance of the color images.

Electron accepting compounds and electron donating colorless dye precursors of the present invention can be dispersed in an aqueous solution of a water-soluble binder. The heat-fusible substance is dispersed by itself or in combination with one of the electron donating colorless dye precursors or electron accepting compound in the aqueous solution of the water-soluble binder. The amount of electron accepting compounds used in the present invention is from 100 to 500 wt%, and preferably from 200 to 300 wt%, based on the weight of electron donating colorless dye precursors. Further, the amount of a heat-fusible substance used in the present invention is from 20 to 300 wt%, and preferably from 50 to 150 wt% based on the weight of electron donating colorless dye precursors.

Specific examples of water-soluble binders which can be used include methyl cellulose, carboxymethyl cellulose, hydroxyethyl cellulose, starches, gelatin, arabic rubber, casein, hydrolyzate of ethylene-maleic anhydride copolymer, hydrolyzate of ethlene-maleic anhydride copolymer, hydrolyzate of isobutylene-maleic anhydride copolymer, polyvinyl alcohol and carboxy modified polyvinyl alcohol.

Into a recording layer of the heat-sensitive recording sheet of the present invention there can be added pigments, water-insolble binders and metal soaps, if desired.

Pigments which can be added include zinc oxide, calcium carbonate, barium sulfate, titanium oxide, lithopone, talc, agalmatolite, kaolin, calcined kaolin, amorphous silica, filler of urea formalin resin, and aluminum hydroxide. It is preferred that these pigments have an oil absorption amount of 50 ml/100 g (pigments) or more.

The water-insoluble binders which can be added in order to improve water proofness of a coating film include synthetic rubber latex and synthetic resin emulsion such as styrene-butadiene rubber latex, acrylonitrile-butadiene rubber latex, methyl acrylate-butadiene rubber latex or vinyl acetate emulsion.

Metal soaps which can be added in order to prevent heat-adhesion with a recording head include emulsions of metal salts of higher fatty acid such as zinc stearate, calcium stearate or aluminum stearate.

The present invention is illustrated in more detail by the following Example and comparative Examples but it should not be limited thereto.

EXAMPLE 20 g of 2-anilino-3-chloro-6-diethylaminofluoran as an electron donating colorless dye precursor were dispersed in a ball mill for 24 hours with 100 g of an aqueous solution of 5 wt% polyvinyl-alcohol ("PVA 105", a trade name produced by Kuraray Co., Ltd.) and this solution was identified as solution A.

60 g of 1,4-bis(p-hydroxycumyl)benzene as an electron accepting compound and 60 g of 1-p-ethylphenoxy-2-phenoxy-ethane as a heat-fusible substance were dispersed in a ball mill for 24 hours with 600 g of an aqueous solution of 5 wt% polyvinyl alcohol and this solution was identified as solution B.

100 g of calcined kaolin ("Ansilex 90", a trade name, manufactured by Engelhard Co., Ltd.) was dispersed by a homogenizer with 100 g of solution of 1 wt% sodium hexa-metaphosphate (as a dispersing acid) and this solution was identified as solution C.

Solution A, B and C were mixed and 60 g of a 30 wt% aqueous solution of zinc stearate ("Hydrin.Z-7", a trade name, manufactured by Chukyo Yushi co., Ltd.) were added thereto and the resulting composition was identified as a coating composition for a heat-sensitive recording paper. The coating composition was coated by a mayer bar on a high quality paper having a basis weight of 50 g/m$^2$ so that the dry coated amount was 5 g/m$^2$. The resulting paper was dried at 50° C. for 5 min. and was subjected to a calendering treatment so that the surface smoothness thereof was 500 sec. (Beck).

COMPARATIVE EXAMPLES 1 TO 3

The same procedure as in Example 1 was repeated except that as an electron accepting compound, 2,2-bis(p-hydroxyphenyl)propane, benzyl-4-hydroxy benzoate and 1,3-bis(p-hydroxycumyl)benzene were used respectively.

COMPARATIVE EXAMPLES 4 TO 9

The same procedure as in Example 1 was repeated except that those compounds as shown in Table were used as a heat-fusible substance.

The thus obtained heat-sensitive recording papers were evaluated in the following manner.

1. Color-forming property (heat-response property):

Test chart No. 3, which was produced by The Institute of Image Electronics Engineers of Japan was duplicated using a high speed faxcimile FF-2000 manufactured by FUJITSU LIMITED and the density of images was measured using a densitometer "RD-918" manufactured by Macbeth Co., Ltd. (at 23° C.±2° C.).

The above test was repeated at a temperature of 5° C. in order to confirm color-forming property (heat-response property) at a lower temperature. The higher the density is, the better the result is.

2. Fog:

Uncolored samples of heat-sensitive recording papers were stored in a oven heated at 70° C. for 1 hour and the densities were measured. The lower the densities are, the better the results are.

3. Resistance to solvents:

Filter papers were impregnated with ethanol toluen and methyl cellosolve respectively, and were placed on the colored images of the thus obtained heat-sensitive recording sheets. The degree of fog thereof was evaluated by a three grades (e.g., A, B, and C). The results hereof are shown in the Table below.

It is clearly seen from the results in the table that the present invention has the most superior effect (i.e., color forming property, fog resistance and resistance to solvent).

While the invention has been described in detail and with reference to specific embodiments thereof, it will be apparent to one skilled in the art that various changes and modifications can be made therein without departing from the spirit and scope thereof.

What is claimed is:

1. A heat-sensitive recording sheet comprising a colorless or pale-colored electron donating colorless dye precursor, an electron accepting compound which forms color when reacted upon heating with the colorless dye precursor and a heat-fusible substance, wherein the electron accepting compound is 1,4-bis(p-hydroxycumyl)benzene and the heat-fusible substance is 1-p-ethylphenoxy-2-phenoxyethane.

2. A heat-sensitive recording sheet as claimed in claim 1, wherein the colorless or pale-colored electron donating colorless dye precursor is selected from triaryl methane compounds, diphenyl methane compounds, xanthene compounds, thiazine compounds or spiropyran compounds.

3. A heat-sensitive recording sheet as claimed in claim 1, wherein the electron accepting compound comprises from 100 to 500 weight % based on the weight of the electron donating colorless dye precursor.

4. A heat-sensitive recording sheet as claimed in claim 3, wherein the heat-fusible substance comprises from 20 to 300 weight % based on the weight of the electron donating colorless dye precursor.

5. A heat-sensitive recording sheet as claimed in claim 1, wherein the heat-fusible substance comprises from 20 to 300 weight % based on the weight of the electron donating colorless dye precursor.

* * * * *

TABLE

| | Electron accepting compound | Heat-fusible compound | Color-forming property (23° C.) | Color-forming property (5° C.) | Fog | Resistance to solvents: ethanol | Resistance to solvents: toluene | Resistance to solvents: methyl cellosolve |
|---|---|---|---|---|---|---|---|---|
| Example | 1,4-bis(p-hydroxycumyl)-benzene | 1-p-ethylphenoxy-2-phenoxy ethane | 1.30 | 1.24 | 0.12 | A | A | A |
| Comparative Example 1 | 2,2-bis(p-hydroxycumyl)-propane | 1-p-ethylphenoxy-2-phenoxy ethane | 1.30 | 1.25 | 0.19 | C | C | C |
| Comparative Example 2 | benzyl 4-hydroxy benzoate | 1-p-ethylphenoxy-2-phenoxy ethane | 1.24 | 1.20 | 0.32 | B | B | B |
| Comparative Example 3 | 1,3-bis(p-hydroxycumyl)-benzene | 1-p-ethylphenoxy-2-phenoxy ethane | 1.26 | 1.22 | 0.14 | B | C | B |
| Comparative Example 4 | 1,4-bis(p-hydroxycumyl)-benzene | stearic acid amide | 1.12 | 0.90 | 0.18 | A | A | A |
| Comparative Example 5 | 1,4-bis(p-hydroxycumyl)-benzene | benzyl p-benzyloxy benzoate | 1.21 | 1.10 | 0.13 | A | A | A |
| Comparative Example 6 | 1,4-bis(p-hydroxycumyl)-benzene | 1,2-bis(ethyl-phenoxy)ethane | 1.18 | 1.09 | 0.13 | A | A | A |
| Comparative Example 7 | 1,4-bis(p-hydroxycumyl)-benzene | 1,2-diphenoxyethane | 1.29 | 1.24 | 0.30 | A | A | A |
| Comparative Example 8 | 1,4-bis(p-hydroxycumyl)-benzene | 1-p-ethylphenoxy-2-phenoxybutane | 1.20 | 1.10 | 0.16 | A | A | A |
| Comparative Example 9 | 1,4-bis(p-hydroxycumyl)-benzene | 1-p-butylphenoxy-2-phenoxyethane | 1.15 | 1.06 | 0.18 | A | A | B |

Remarks:
A: Good
B: Fair
C: Unacceptable